United States Patent [19]

Gwiazda

[11] Patent Number: 4,702,396

[45] Date of Patent: Oct. 27, 1987

[54] APPARATUS FOR PRESERVING AND DISPENSING WINE

[76] Inventor: Ronald E. Gwiazda, 143 Mt. Vernon St., West Roxbury, Mass. 02132

[21] Appl. No.: 827,728

[22] Filed: Feb. 10, 1986

[51] Int. Cl.[4] ..... B65D 83/14

[52] U.S. Cl. ..... 222/152; 222/5; 222/399; 215/311; 426/394; 426/397

[58] Field of Search ..... 222/152, 394, 396, 397, 222/399, 400.7, 464, 5, 478–479, 481, 482; 215/231, 311, 314, 3, 4; 426/394, 397, 404; 99/323.1; 239/309

[56] References Cited

U.S. PATENT DOCUMENTS

| | | | |
|---|---|---|---|
| 2,204,833 | 6/1940 | Stone | 53/428 |
| 2,862,528 | 12/1958 | Geisler | 53/510 X |
| 3,212,537 | 10/1965 | Hinxlage et al. | 53/432 X |
| 3,343,701 | 9/1967 | Mahoney | 215/231 |
| 3,406,080 | 10/1968 | Gibble | 53/432 X |
| 4,392,578 | 7/1983 | Fipp et al. | 215/231 |
| 4,473,174 | 9/1984 | Heuser | 222/152 |
| 4,477,477 | 10/1984 | Arter | 426/330.4 |
| 4,595,121 | 6/1986 | Schultz | 222/1 |
| 4,624,391 | 11/1986 | Shannon | 222/53 |

OTHER PUBLICATIONS

Yoshihashi, "High-Tech Way to Wine by the Glass", New York Times, Jan. 8, 1986.

"The Winebar", (brochure), Winebar Ltd.

"The Winebar Jr.", (brochure), Winebar Ltd.

*Primary Examiner*—Joseph J. Rolla

*Assistant Examiner*—Michael S. Huppert

*Attorney, Agent, or Firm*—Joseph S. Iandiorio; William E. Noonan; Douglas E. Denninger

[57] ABSTRACT

A compact and portable wine dispensing device is provided, having a support structure coupled to a closure member which fits into the neck of the wine bottle, which structure supports a removable inert gas cartridge, a gas purge valve, a wine dispensing valve, an extended gas feeder tube, an extended wine feeder tube, a gas pressure restriction regulator, a bottle switching valve and a one way valve. The portable dispensing device is fitted within the neck of the bottle, the gas cartridge is then inserted into the device and activated, and the gas purge valve is actuated to cause the inert gas within the cartridge to purge oxygen within the space above the wine, which air passes through the purge valve and out into the atmosphere. The wine is thus protected from oxidation during storage, and upon being utilized again, the wine dispensing valve is turned on and the wine is dispensed therethrough, due to the elevated pressure above the wine in the bottle, which forces the wine up through the extended wine feeder tube and through the dispensing valve. Upon finishing the wine, the bottle switching valve is closed and the device is removed from the empty wine bottle, such valve preventing discharge of gas from the cartridge.

7 Claims, 2 Drawing Figures

APPARATUS FOR PRESERVING AND DISPENSING WINE

FIELD OF THE INVENTION

This invention relates to the field of storing and dispensing wines.

BACKGROUND OF THE INVENTION

The problem of storing partially emptied bottles of fine wines in a manner to preserve the integrity of the wine has been recognized for sometime. In U.S. Pat. No. 3,343,701 to Mahoney, an elastic bulb in its collapsed state is inserted into a partially emptied wine bottle in the space above the wine. The bulb is inflated with air to cause the bulb to occupy most of the space above the unconsumed wine, and in the bulb inflation process, air is forced out of the bottle through an escape tube. One problem with this approach is that the use of such an awkward apparatus by a wine connoisseur is at least somewhat inelegant. It may also be detrimental to the wine to have an elastic material contact the wine itself, in contrast with materials such as glass.

In U.S. Pat. No. 4,477,477 issued to Arter, a gas capsule supplies inert gas such as nitrogen under pressure through a gas feeder tube which causes most of the air in a partially emptied wine bottle to be displaced by nitrogen, before the corking of the bottle. While this process is believed to be more practical than the aforesaid bulb expansion method, it also is somewhat inelegant, as the apparatus is fairly bulky. Additionally if the wine consumer forgets to utilize the apparatus before corking the bottle for storage, the wine may be spoiled owing to the presence of air in the bottle.

SUMMARY OF INVENTION

It is therefore the object of this invention to purge air from the wine bottle and replace that air with nitrogen under pressure that preserves the wine, as well as serves as a means of dispensing it, regardless of whether the wine bottle is used during a number of different occasions before the contents are emptied, e.g. served by the glass in a restaurant.

It is a further object of this invention to have the nitrogen or other inert gas be automatically fed by a pressure regulator into the bottle to replace consumed wine and to also enable automatic feeding of the wine through a wine supply valve into the glass of the consumer upon demand.

Thus a novel, compact and portable wine dispensing device is provided, having a support structure coupled to a closure member which fits into the neck of the wine bottle, which structure supports a removable inert gas cartridge, a gas purge valve, a wine dispensing valve, an extended gas feeder tube, an extended wine feeder tube, a gas pressure restriction regulator, a bottle switching valve and a one way valve. The portable dispensing device is fitted within the neck of the bottle, the cartridge is thereafter screwed into the device and activated, and the gas purge valve is opened to cause the inert gas within the cartridge to purge air within the space above the wine, which air passes through the purge valve and out into the atmosphere. The wine is thus protected during storage, and upon being served the wine dispensing valve is turned on and the wine is dispensed therethrough, due to the elevated pressure above the wine in the bottle, which forces the wine up through the extended wine feeder tube and through the dispensing valve. During this step more inert gas is supplied automatically by the regulator to maintain the elevated pressure within the bottle. Upon finishing the wine, the bottle switching valve is closed and the device is removed from the empty wine bottle, such valve preventing discharge of gas from the cartridge. The device is thereafter reinserted into a second bottle before or after the contents have been partially consumed, and the process is repeated. The one way valve enables an exhausted cartridge to be removed, during use of the device, without causing the bottle pressure to be lost or the regulator damaged, should the user forget to close the bottle switching valve.

DESCRIPTION OF PREFERRED EMBODIMENT

Figure 1:
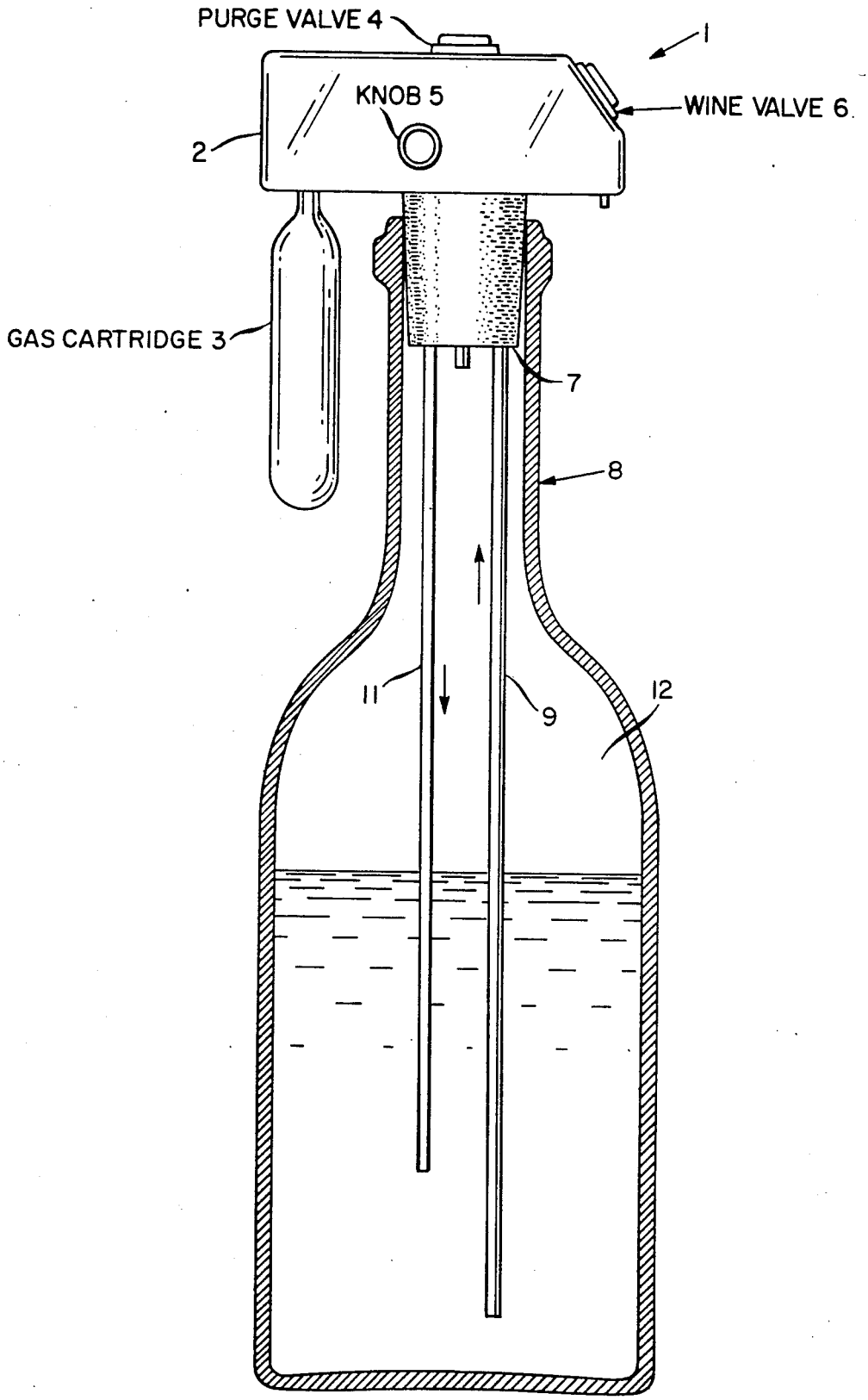
Figure 2:
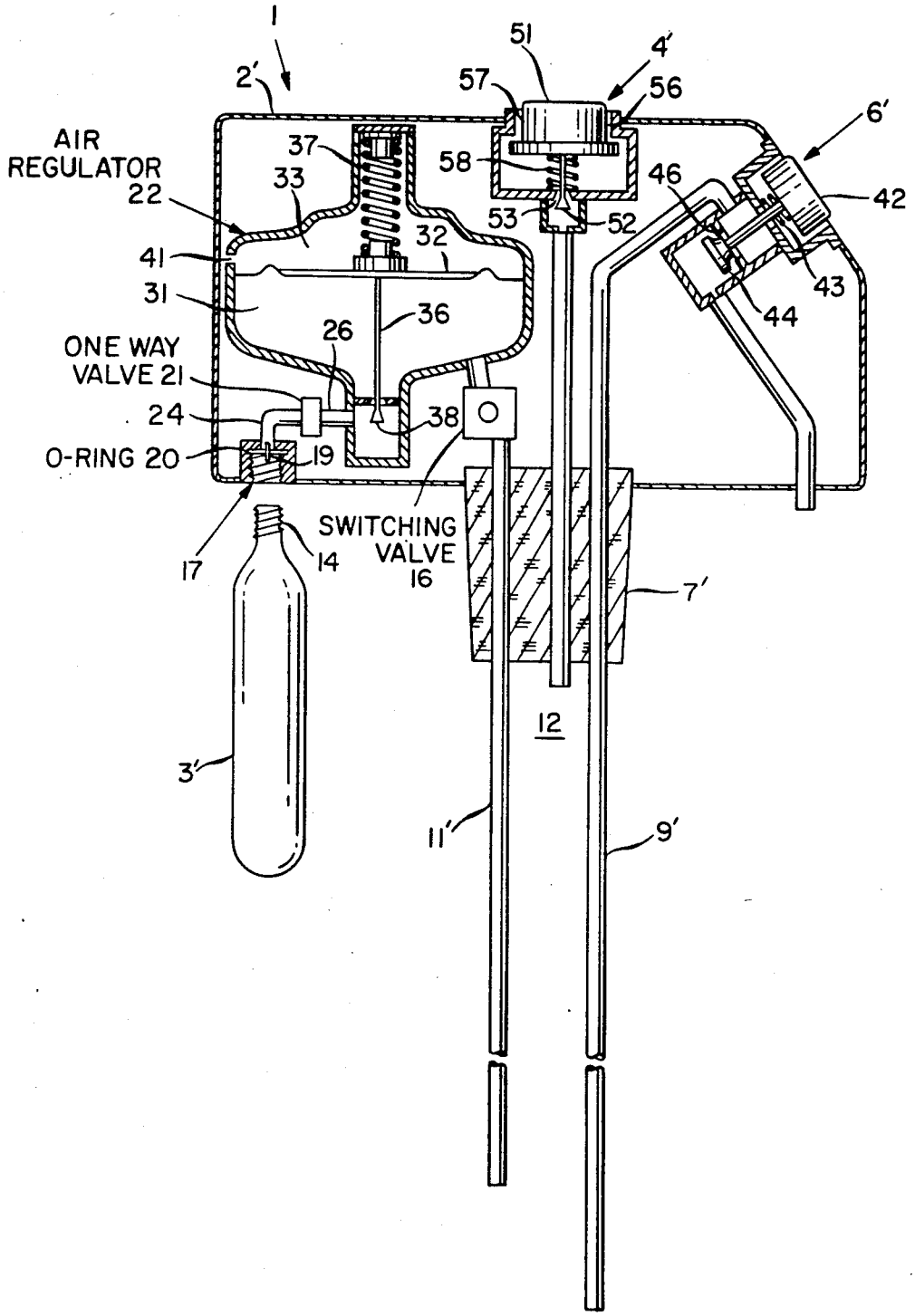

Other objects, features, and advantages of the present invention will become apparent from the following description of a preferred embodiment and the accompanying drawings:

FIG. 1 illustrates an embodiment of the invention positioned within a wine bottle; and FIG. 2 illustrates in greater detail various components positioned within the support device shown in FIG. 1.

Referring now to FIG. 1, portable wine dispensing device 1 includes a support housing 2, a gas cartridge 3, a manual gas purge valve 4, and a wine dispensing valve 6. A resilient cork-like closure member 7 will be fitted within the neck of bottle 8 upon use, and a wine feeding conduit or tube 9 together with a gas feeder conduit tube 11 extends toward the bottom portion of the wine bottle 8.

Before the wine dispensing device on the bottle becomes operational, gas cartridge 3' having a threaded end portion 14 shown in FIG. 2, is screwed into a threaded cartridge support cavity 17, whereby a firing pin 19 pierces the seal of the cartridge, so that the path of gas flow is through one-way valve 21, pressure restriction regulator 22, bottle switching valve 16, and gas feed tube 11'. Tube segments 24 and 26 are utilized to couple the components together as illustrated, and purge valve 4 is manually opened, so that the air in the space 12 above the wine is displaced by inert gas, preferably nitrogen, passing through feeder tube 11 and bubbling up through the wine. The wine is now protected during storage. Upon subsequent actuation of wine dispensing valve 6 after storage, the pressurized inert gas within portion 12, forces the wine up through wine feeder tube 9 and through the wine dispensing valve 6 into the glass of the consumer. Each time wine dispensing valve 6 is opened and wine is forced out of the bottle, more gas is automatically supplied by pressure regulator 22 via gas feeder tube 11 to maintain the pressure within the bottle. The bottle is thereafter stored until it is to be used again. When the wine is later dispensed through valve 6, further quantities of gas will pass from the cartridge 3 into space 12 via gas feeder tube 11, thereby to maintain always the gas in space 12 under pressure, to facilitate in turn driving the wine up through wine supply tube 9 and wine valve 6 into the glass of the consumer. Thus, it should be apparent that the wine may be continuously consumed in small quantities over long periods of time, without exposing the wine to air.

When the bottle is emptied, the bottle switching valve 16 is closed to prevent discharge of gas cartridge 3 to the atmosphere when the entire dispensing device 1 is removed from the empty bottle. The device is thereafter inserted into another full or partially emptied bottle, and bottle switching valve 16 is thereafter opened, and inert gas flows under pressure from the gas cartridge 3 to the gas feeder tube 11 via one-way valve 21, pressure restriction regulator 22, and bottle switching valve 16. Purge valve 4 is actuated and air is substantially replaced by the inert gas, as before.

The purpose of pressure restriction regulator 22, shown in detail in FIG. 2, is to maintain the pressure of the nitrogen slightly above atmospheric pressure, to prevent a too abrupt surge of wine into the consumers glass which could occur if greater gas pressure existed in the bottle; such greater gas pressure could also possibly blow the device out of the bottle. One-way valve 21 makes it safe to change cartridges while the dispensing device is in use. It would be possible to change cartridges by closing bottle changing or switching valve 16, but if the user forgot to close valve 16 before removing the empty cartridge, or if O ring 20 failed in normal use and the cartridge leaked into the atmosphere, the pressure in the bottle would force wine up gas feeder tube 11 into the regulator and might destroy the regulator.

Regulator 22 is divided by diaphragm 32 into a lower chamber 31 and an upper chamber 33 as indicated in FIG. 2. Initially, pressurized gas passes through one-way valve 21, the area surrounding valve stem 36, through the lower chamber 31 of the regulator, through switching valve 16, and into the wine bottle via tube 11'. As mentioned previously, nitrogen continues to bubble into the bottle until the pressure in the bottle has reached a preestablished level above atmospheric pressure. Such pressure level is established by spring 37 which urges diaphragm 32 in a downward direction. When the gas pressure in the lower chamber 31, reaches the pre-established level, valve stem 36 is raised to a sufficient extent to cause valve member 38 to close the valve. As the wine is dispensed, the pressure in chamber 31 will drop to a sufficient extent to cause valve member 38 to become unseated owing to the action of spring 37 to again permit gas to pass through one-way valve 21 into the lower chamber 31 of regulator 22. Orfice 41 formed within the upper chamber 33 of the regulator maintains chamber 33 at atmospheric pressure. In this manner, the pressure within the bottle is maintained at a pre-established level above atmospheric pressure, to enable the dispensing of wine through valve 6'. Valve 6' comprises actuation button 42 having a spring 43 for maintaining valve member 44 against valve seat 46. The user presses against button 42, to cause valve member 44 to become separated from valve seat 46, and wine flows through the resulting orfice produced by the separation of valve member 44 from seat 46. Gas purging valve 4' may be a similar type whereby the user presses downwardly upon button 51 to cause valve member 52 to become separated from valve seat 53 to enable air to flow through the resulting orfice, and around sides 56 and 57 of the button. Spring 58 causes the valve member 52 to again be seated within valve seat 53 when the user ceases to press down upon button 51.

Valve 21 functions to prevent decrease in pressure due to leakage or removal of cartridge 3. Without valve 21 such a decrease in pressure could cause the wine to back up into the regulator 22. Valve 21 also permits the cartridge to be replaced while the bottle is kept pressurized. Valve 16 allows removal of unit 2 from one bottle to be reinstalled on another without losing the remaining nitrogen. This is a valuable feature because different bottles will require different amounts of purging nitrogen and the bottles and cartridges generally do not empty simultaneously.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A portable wine dispensing device comprising an apparatus for mounting on an individual wine bottle, including a wine bottle closure member, support means for supporting a removable inert gas cartridge, a gas purge valve, a wine dispensing valve, an extended gas feeder conduit and an extended wine feeder conduit coupled to said dispensing valve, a one-way valve, gas feeder conduit means for supplying gas under pressure from said gas cartridge to said extended gas feeder conduit through said one-way valve, pressure regulator means coupled between said gas cartridge and said extended gas feeder conduit for controllably starting and stopping the flow of gas from said cartridge to maintain the pressure in the bottle at a substantially constant level above atmospheric pressure, and gas purging gas conduit means coupled between said gas purge valve and inside portions of said bottle.

2. A portable wine dispensing device comprising an apparatus for mounting on an individual wine bottle, including a wine bottle closure member, support means for supporting a removable palm-sized inert gas cartridge, a wine dispensing valve, and extended gas feeder conduit, an extended wine feeder conduit coupled to said dispensing valve, gas feeder conduit means for supplying gas under pressure from said gas cartridge to said extended gas feeder conduit, and pressure regulator means coupled between said gas cartridge and said extended gas feeder conduit for controllably starting and stopping the flow of gas from said cartridge to maintain the pressure in the bottle at a substantially constant level above atmospheric pressure.

3. A portable dispensinsg device for dispensing liquid from an individual pressurizable container having an elongated neck, comprising an apparatus for mounting on the elongated neck of said container, including a container closure member, support means for supporting a removable inert gas cartridge, a liquid dispensing valve, an extended gas feeder conduit, an extended liquid feeder conduit coupled to said dispensing valve, a container switching valve, gas feeder conduit means for supplying gas under pressure from said gas cartridge to said extended gas feeder conduit through said container switching valve, and pressure regulator means coupled between said gas cartridge and said extended gas feeder conduit for controllably starting and stopping the flow of gas from said cartridge to maintain the pressure in the container at a substantially constant level above atmospheric pressure.

4. A portable wine dispensing device comprising an apparatus for mounting on an individual wine bottle, including a wine bottle closure member, support means for supporting a removable inert gas cartridge, a wine dispensing valve, an extended gas feeder conduit, an extended wine feeder conduit coupled to said dispensing valve, a one-way valve, gas feeder conduit means for supplying gas under pressure from said gas cartridge to said extended gas feeder conduit through said one-way valve, and pressure regulator means coupled between said gas cartridge and said extended gas feeder conduit for controllably starting and stopping the flow of gas from said cartridge to maintain the pressure in the bottle at a substantially constant level above atmospheric pressure.

5. The device of claim 4 further including a bottle switching valve coupled between said gas cartridge and said extended gas feeder conduit for preventing flow between said gas cartridge and said gas feeder conduit.

6. The device of claim 4 further including a gas purge valve and gas purging gas conduit means coupled between said gas purge valve and inside portions of said bottle.

7. The dispensing device of claim 6 wherein a small gas cartridge is utilized, having a capacity for dispensing wine from no more than a single large wine bottle.

* * * * *